United States Patent [19]

Hancock et al.

[11] 4,023,285

[45] May 17, 1977

[54] FOUR-WHEELED ELEVATING SCRAPER

[75] Inventors: James E. Hancock; Howard E. Stuller, both of Lubbock, Tex.

[73] Assignee: Clark Equipment Company, Buchanan, Mich.

[22] Filed: Feb. 11, 1974

[21] Appl. No.: 441,091

Related U.S. Application Data

[63] Continuation of Ser. No. 258,619, June 1, 1972, abandoned.

[52] U.S. Cl. ..... 37/8; 214/506; 37/126 R

[51] Int. Cl.² ..... E02F 7/00

[58] Field of Search ..... 37/4, 7–9, 37/124, 126, 127, 128, 129; 214/506; 280/47.23; 198/188, 189, 195, 198, 203, 159, 102

[56] References Cited

UNITED STATES PATENTS

| | | | |
|---|---|---|---|
| 1,005,617 | 10/1911 | Doud | 280/47.23 |
| 1,513,469 | 10/1924 | Robinson | 280/47.23 |
| 1,780,299 | 11/1930 | Jackson | 37/8 X |
| 1,784,284 | 12/1930 | Guy et al. | 37/7 X |
| 1,829,198 | 10/1931 | Speer | 37/8 |
| 1,955,997 | 4/1934 | Yant | 280/47.23 X |
| 2,464,098 | 3/1949 | Pittlick | 37/8 |
| 2,978,252 | 4/1961 | Osborne | 280/47.23 X |
| 3,083,479 | 4/1963 | Knight | 37/126 A |
| 3,090,139 | 5/1963 | Hancock | 37/8 |
| 3,126,653 | 3/1964 | Bourgeous | 172/4.5 |

*Primary Examiner*—E. H. Eickholt
*Attorney, Agent, or Firm*—Kenneth C. Witt

[57] ABSTRACT

An elevating scraper having a four-wheeled tandem running gear. The elevator is divided into parallel loading paths to accommodate a drive line between the paths. Thus the scraper is particularly suited for towing by a tractor having a power takeoff at the rear. The construction also features a knock-down assembly for minimum utilization of shipping space.

11 Claims, 5 Drawing Figures

FOUR-WHEELED ELEVATING SCRAPER

This is a continuation, of application Ser. No. 258,619, filed June 1, 1972, now abandoned.

BACKGROUND OF THE INVENTION

The invention pertains to the art of self-loading scrapers having a dirt collecting bowl with an elevator mechanism inclined downwardly at the front of the bowl to assist in moving the dirt off of the scraper blade and into the bowl.

1. Field of the Invention

The larger sized industrial scrapers will normally be towed by a special, heavy duty, two-wheeled prime mover. The elevator is driven by an elevator drive group, typically an hydraulic motor and reduction gearing powered by an hydraulic pump driven off of the engine of the prime mover.

For smaller sized scrapers of generally under 10 cubic yards capacity, often referred to as utility or agricultural scrapers, a lower horsepowered tractor may be used and most commonly a four-wheel farm tractor having a hitch and a power takeoff. An elevator drive line is attached to the power takeoff of the tractor for driving the elevator through a gear box mounted at the top and on one end of the elevator drive shaft. A two-wheeled utility scraper of the type referred to is disclosed in U.S. Pat. No. 3,090,139 entitled 37 Two Wheeled Scraper" issued May 21, 1963 which by mesne assignment is assigned to the assignee of the present invention.

The present invention will most advantageously be employed and find its greatest application in the smaller sized or utility scraper field, although it should be appreciated that many of the features of the invention are applicable equally to the industrial scrapers.

2. Description of Prior Art

With the two-wheeled utility scraper of the type disclosed in the aforementioned U.S. Pat. No. 3,090,039, the elevator is driven by a gear box mounted on one end of the elevator drive shaft at the top of the elevator. The drive line from the tractor power takeoff to the gear box is required to take a somewhat tortuous path considering the lower position of the power takeoff and the higher, offset position of the gear box.

Also, since it is necessary that the tractor be turned with respect to the center line of the scraper, the drive line must employ several telescoping sections, special pivot bearings and a number of U-joints in order to maintain effective drive to the elevator.

With the small two-wheeled utility scraper, such as shown in the aforementioned patent, there is no suspension. The wheels are directly mounted on the scraper body such that if the scraper encounters a rock or any change in elevation, a substantial change in the blade height is unavoidable, making it difficult to produce a uniform depth of cut.

Moreover, because only two wheels are supporting the load the tire width must be greater to provide lateral support and distribute the ground pressure. Consequently, wide side blade extensions or moldboards are required to cut out the tread width.

Heretofore the scraper bowl has been an all welded construction believed to be required for greater strength and rigidity. Welding fabrication of the bowl takes place at the factory. Assembly of certain other components, such as the elevator, may be performed by the customer. However, the greatest bulk is the bowl and for all practical purposes the largest portion of the freight charge is for the bowl. This is a factor which is believed to have detracted from wider usage particularly of the utility scraper.

To our knowledge there has been no scraper before now especially designed for shipment in knocked down form, that is, where the various components, including the scraper bowl, are shipped disassembled in a compact, banded or crated form to obtain maximum utilization of shipping space.

SUMMARY OF THE INVENTION

A scraper having an open bowl with laterally spaced side walls, a main blade, an elevator to assist in filling the bowl and a bottom door movable to an open position for dumping and spreading the earth material collected in the bowl, providing a suspension wherein the scraper is supported on a tandem running gear mounting four ground engaging wheels. Two wheels, one behind the other, are mounted on a rocking beam on each side of the bowl. The rocking beams are supported for independent rocking action on a common transverse axis such that the bowl may be tilted about the axis to vary the depth of cut.

In more specific application each rocking beam is supported on an axle section telescopically received in a transverse axle housing secured between the scraper side walls. The axes sections are inserted in opposite ends of the axle housing and project through the scraper side walls for mounting the rocking beams. Oscillation of the load support wheels is permitted by the rocking action of the beams. In addition to a more constant depth of cut, the tandem running gear arrangement distributes the load over a greater tire area while permitting the use of narrower tires. This increases the effective bowl width.

Another feature of the invention is an elevator design taking into account the problems of the prior art where the drive line was of extended length and complexity because of the position of the tractor power takeoff with respect to the elevator gear box. In accordance with this aspect of the invention, the elevator drive is at the bottom rather than at the top as in the prior art. A bottom drive elevator is described in co-pending U.S. Pat. application Ser. No. 167,764 filed July 30, 1971, now abandoned, entitled "Scraper Elevator" assigned to the assignee of the present invention. One of the features of the invention as set forth in the aforementioned application is that with the drive at the bottom, a lower center of gravity is obtained. This results in a smoother elevator action because the weight of the elevator is concentrated close to the digging line tending to reduce elevator chain flexing and chatter. This arrangement also keeps the elevator flights more firmly engaged with the soil during the digging stroke. These and other advantages are described in the subject application which to a large extent are also realized in the present invention. More directly applicable, however, to the utility scraper is the location of the drive at the bottom which results in a nearly straight drive line from the tractor power takeoff.

According to this aspect of the invention the elevator has two parallel loading paths. A frame having a center support member carries both paths, one on each side of the bowl. This provides a dual sectioned elevator with each section being spaced at the center of the bowl to allow access for the drive line to the elevator at the bottom. As a result the input for the elevator gear box is practically on a straight line from the power takeoff of the tractor tending to greatly reduce drive line wear and maintenance problems.

Another feature of the invention is a double door dump arrangement permitting the operator to achieve better control of the dumping and spreading of dirt. The arrangement provides a front swinging bottom door, which in a closed position provides a floor in the front portion of the bowl and a rear swinging door which closes the rear portion. The doors are interconnected by an actuating linkage and a pair of hydraulic cylinders, one on each side of the scraper, operate the double doors.

Another feature is the provision of an automatic moldboard clean-out mechanism. A push rod extends down on the outside of the bowl and through the back of the moldboard on each side of the bowl. Upon actuation of the door operating cylinders, the push rods are reciprocated and in so doing clean out the corners of the blade where earth material has a tendency to become trapped.

A still further important feature of the invention is the provision of a plurality of bolt-together scraper components, including the bowl, designed to be assembled without sacrificing strength or ridigity. This permits a scraper assembly of components to be crated, banded or containerized for shipment in compact, disassembled kits occupying a minimum of cubic feet in cargo space reducing freight charges. The design contemplates rapid and relatively easy assembly without special jigs or fixtures enabling completion by the customer or user on the job site.

These and other advantages will be more fully apparent by referring to the following detailed description of a preferred embodiment which precedes with a brief description of the drawings.

DESCRIPTION OF PREFERRED EMBODIMENT

Figure 1:
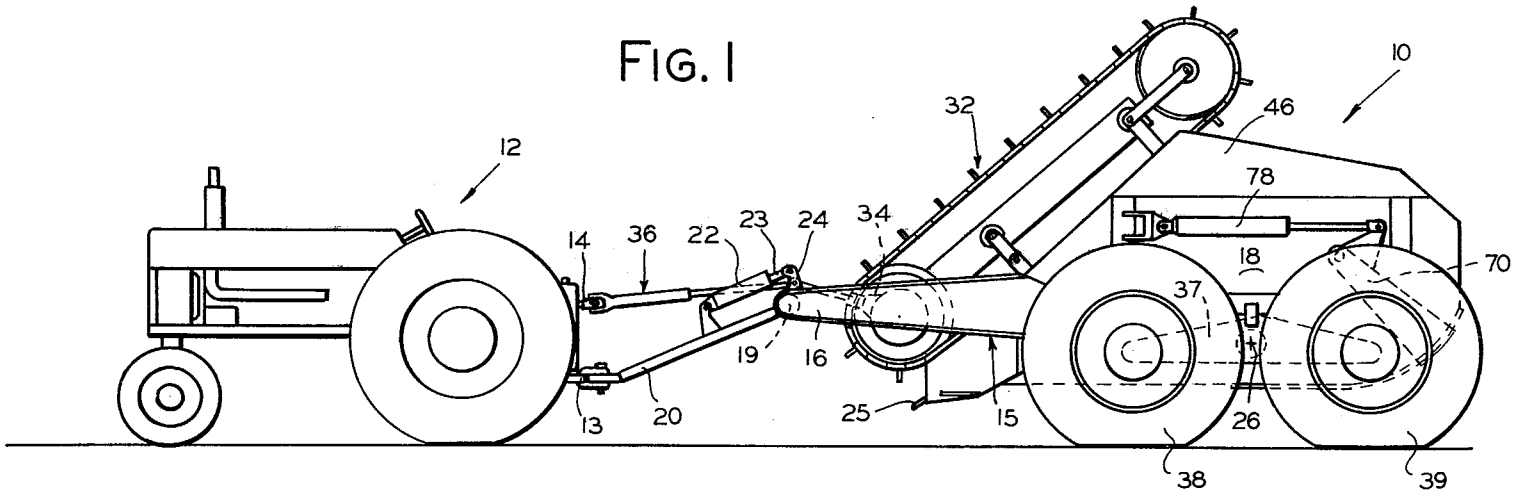
FIG. 1 is a side elevational view showing a preferred embodiment of the four-wheel elevating scraper being towed by an agricultural tractor having a hitch and power takeoff.

FIG. 1 depicts an elevating scraper 10 towed by a tractor 12. The tractor is a four-wheeled agricultural tractor having a drawbar hitch 13 and a power takeoff 14, however, it will be appreciated that the towing vehicle is not a part of the invention. The scraper 10 has a tongue 15 pivotally connected to the tractor hitch 13 permitting articulation of the scraper relative to the tractor. The tongue 15 comprises a pair of arms 16 extending forwardly from the scraper sidewalls 18 and joined at the front by a crossbeam 19. The crossbeam 19 carries a pair of laterally spaced sleeve bearings (not shown) on which is journaled a tongue extension 20 which connects with the hitch 13. An hydraulic cylinder 22, which is connected with the hydraulic system of the tractor 12, has an extensible rod 23 pivotally connected to an arm 24 fixed on the crossbeam 19 such that upon extension or retraction of the cylinder rod 23 the tongue extension 20 and the tongue arms 16 jackknife or pivot relative to each other about the crossbeam 19 and in so doing pivot the scraper bowl about the main transverse axis 26 of the tandem running gear to raise and lower the scraper blade 25. An elevator 32 is mounted on the front of the scraper 10 to break loose dirt in advance of the blade 25 when in the lowered position and to assist in filling the bowl. The elevator incorporates a design particularly suited for the smaller or utility scraper, as will be discussed below, where the power takeoff 14 of the tractor is connected to the elevator bottom drive, generally indicated at 34, by a drive line 36. The scraper 10 is supported on four wheels, two on each side, one behind the other, mounted on rocking beams 37 in a manner such that the rear wheels 39 track behind the front wheels 38 on each side. The tandem running gear is an important feature of the invention as discussed further below.

Figure 3:
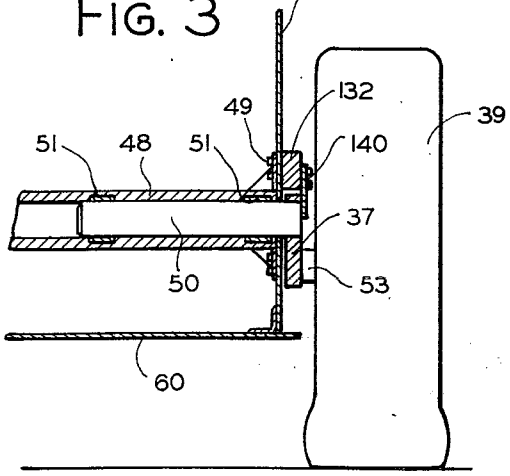
FIG. 3 is a partial transverse sectional view of the scraper bowl taken through the axle housing of the tandem running gear.
Figure 2:
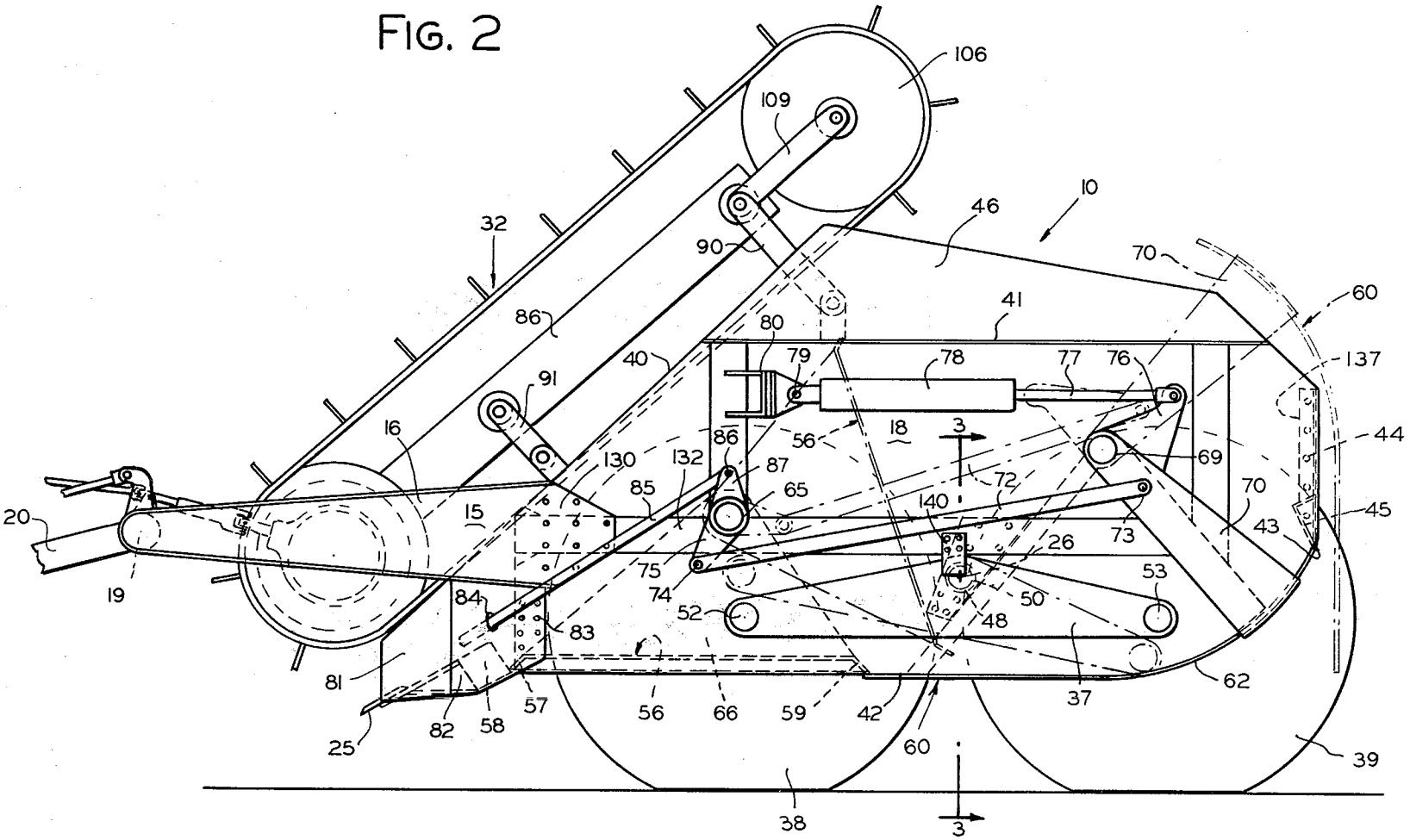
FIG. 2 is a side view of the scraper shown in FIG. 1 depicting in partial dashed lines the open position of the swinging double bottom doors.

Referring now to FIG. 2, the scraper bowl includes a pair of laterally spaced side walls 18 having a downwardly inclined front edge 40, a horizontal top edge 41, and a horizontal bottom edge 42 which curves upwardly at the rear portion 43 thereof. A fixed end wall 44 extends between the side walls 18 at the rear and has a lower transverse edge portion 45 the function of which will be explained below. Fastened to the upper edge 41 of each side wall 18 is a sideboard extension 46 permitting the dirt to be heaped in the bowl to a level above the side walls 18 at least adjacent the top of the elevator 32 as is customary practice in the operation of elevating scrapers. Extending between the side walls 18 approximately midway between the front and rear of the bowl and spaced upwardly from the bottom edges 42 is a transverse axle housing 48 secured at the opposite ends by gusset plates 49 (FIG. 3) to the innerside of side walls 18. An axle section 50 is inserted in each end of the axle housing 48 through the side walls 18 and is journaled on laterally spaced sleeve bearings 51 in the housing 48 permitting independent oscillation of the rocking beams 37. Each rocking beam 37 carries at the forward end thereof a stub axle 52 and at the rear end a stub axle 53 on which stub axles are mounted respectively the front and rear ground engaging wheels 38 and 39.

The bottom area of the scraper bowl is closed by a front door 56 (FIG. 2), the leading edge 57 of which engages with the rear of the blade support frame 58 and the trailing edge 59 of which is met by a rear door 60 which extends rearwardly terminating in an upwardly curved portion 62 which generally follows the curvature of the edge portion 43 of the side walls 18 and closes at the rear with the bottom edge 45 of the end wall 44. The front door 56 is pivoted on a pair of trunnions 65 in the opposite side walls 18. A pair of skirts members 66, one suspended from each trunnion 65 supports the front door 56 for swinging motion about the axis of the trunnion 65 from a closed position to a fully open position as shown in the partial dashed line view in FIG. 2. The rear door 60 is pivoted on a pair of trunnions 69 in the opposite side walls 18 to the rear and above the trunnion 65. A pair of arms 70, one journaled on each trunnion 69, extend down on the outside of the side walls 18 connecting at the lower ends with the curved portion 62 of the rear door 60 such that the latter may be pivoted about the axis of trunnions 69 from a closed position to a fully open position depicted in dashed lines in FIG. 2. An actuating link 72, one on each side of the bowl, is pivoted at the rear end at 73 to the arm 70 and extends forwardly where it is pivoted at 74 to a lever 75 connected by a sleeve bearing to the skirt member 66 of the front door 56. Levers 76 connect the arms 70 of the rear door 60 to cylinder rods 77 of hydraulic cylinders 78 on each side of the scraper. The blind end 79 of each cylinder 78 is pivotally connected to an anchor block 80 mounted on the exterior of side walls 18. Thus, upon actuation of the cylinders 78 retracting the rod 77 the front door 56 and the rear door 60 swing rearwardly and upwardly about the trunnion axes and in the process move toward fully open positions shown respectively for each door in FIG. 2. The relationship of the curvature of the rear portion 62 of door 60 with the bottom edge 45 of the end wall 44 is such that the edge 45 will scrape the inner curved surface of the door 60 removing any sticky earth material as the door is being opened. Thus, the bowl has a double bottom dump capability such that the dirt pours out during the dumping cycle at two locations, first behind the blade frame 58 and second, near the center of the bowl between the doors 56 and 60, the dumping being controlled by the amount the doors are opened.

Figure 5:
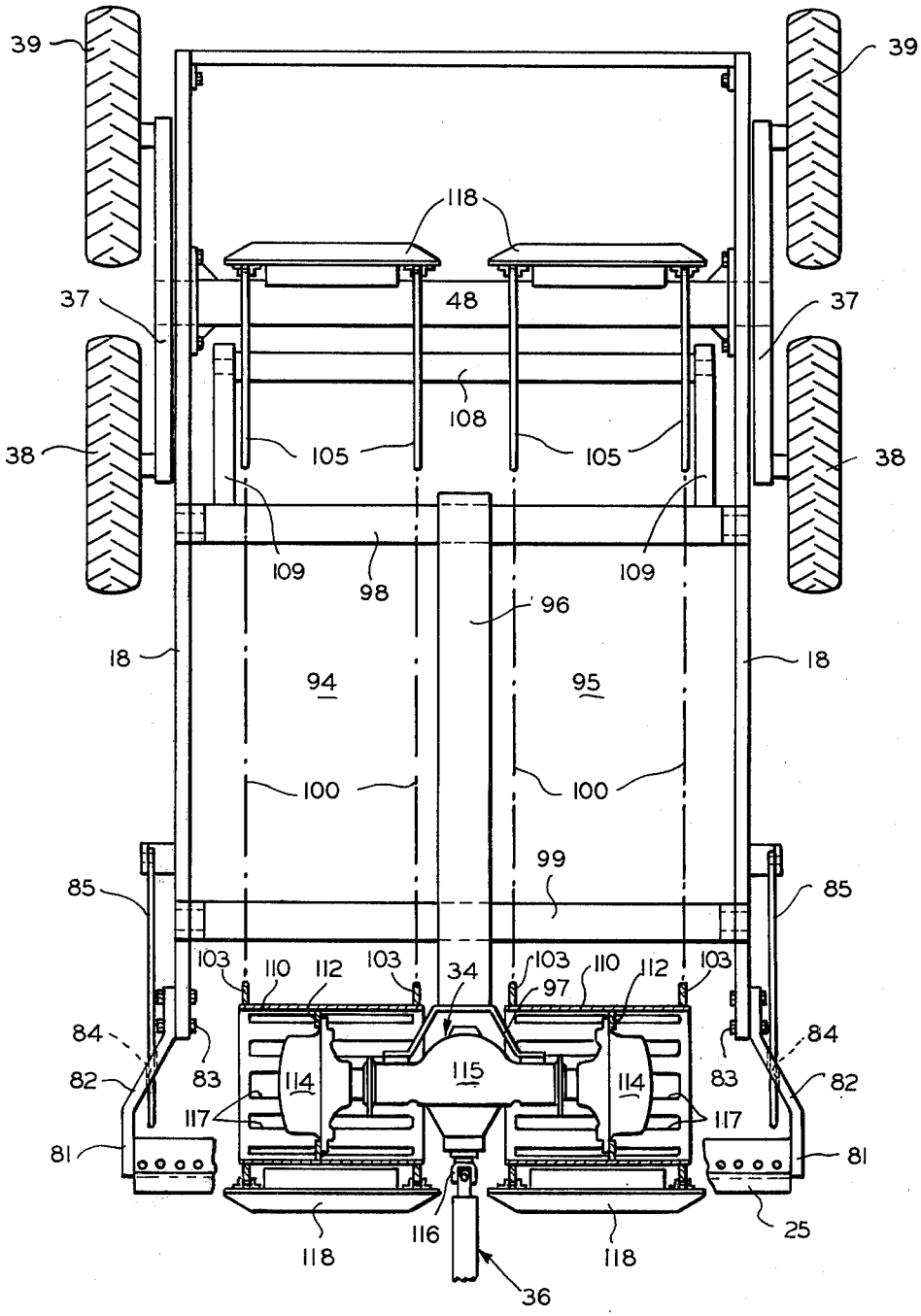
FIG. 5 is a plan view of the scraper in FIGS. 1 and 2 showing the elevator bottom drive and the tandem running gear.

As seen in FIG. 5, the main blade 25 and blade frame 58 extend across the front of the bowl between side wall extensions or moldboards 81 each having a laterally extending portion 82 which at the rear end is directed parallel to the side walls 18 and bolted thereto by bolts 83. Projecting through an opening 82 in the rear portion 82 of each moldboard is a push rod 85 pivotally connected at the upper end 86 to a lever 87 (FIG. 2) mounted on the rotatable sleeve portion of lever 75. Thus, upon actuation of the cylinders 78 opening the doors, the push rods 85 are extended through the moldboards along a line generally inclined downwardly and parallel to the blade 25 tending to dislodge any sticky material which may have become collected in the corners of the blade.

Referring now to FIG. 5, the elevator 32 is comprised of two sections or parallel 94–95, one on each side of the bowl. Each section 94–95 is supported on an elevator frame including a center support 96 at which at the lower end carries a saddle bracket 97 supporting the elevator drive 34 and at the top has a cross member 98. Spaced below the upper cross member 98 is a cross member 99 passing through the center support 96 which together with the upper cross member 98 supports the elevator paths 94–95 across the front of the bowl. Opposite ends of the cross members 98–99 are pivotally connected to the side walls 18 by links 90–91 (FIG. 2) allowing the elevator sections to shift in a vertical plane. Each elevator section 94–95 includes a pair of chains 100 (depicted by the dot-dash lines in FIG. 5) which are trained over drive sprockets 103 at the bottom and over idler wheels 105 at the top. The idler wheels are in laterally spaced alignment with the drive sprockets 103 at the bottom and are mounted on a rotatable shaft 108, the opposite ends of which are journaled in a pair of extension arms 109 projecting upwardly from the upper cross member 98 of the elevator frame. The drive sprockets 103 are mounted in laterally spaced alignment with the idler wheels 105 on drums or carriers 110 having a central, inwardly directed ring 112 which bolts to the drive hub 114 at each end of the elevator drive 34. Saddle bracket 97 supports the drive at the center housing 115 which has an input shaft carrying a U-joint 116 which is connected to drive line 36. The elevator drive 34, according to the preferred embodiment, will be a standard planetary truck axle, the planetary sets at each end of which are utilized to drive the two elevator sections 94–95. The carriers 110 are open cage structures to permit the egress of dirt which may have a tendency to collect within the rotating carriers and in this connection slots 117 are provided. A series of flights or drags 118 are carried by the chains 100 of each elevator section 94–95, being spaced from each other on opposite sides of a vertical center plane through the elevator drive 34 to provide access for the drive line 36.

Figure 4:
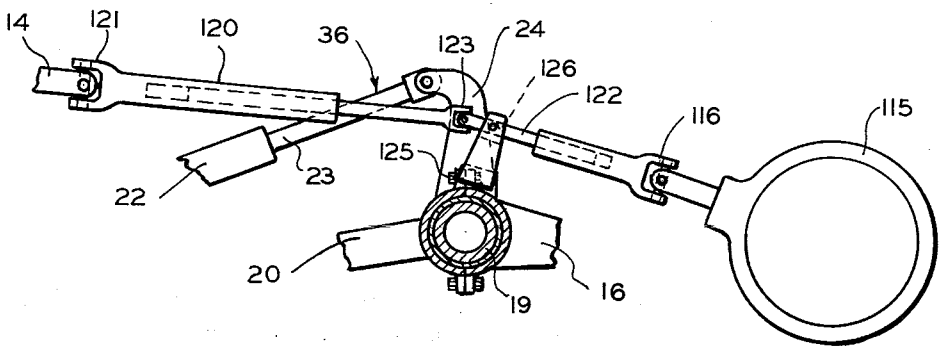
FIG. 4 is a view of the drive line between the tractor power takeoff and the elevator gear box.

Referring to FIG. 4 the drive line 36 includes a telescoping section 120 connected on one end to the tractor power takeoff 14 by means of a U-joint 121 and at the opposite end to a second drive section 122 by means of a U-joint 123. The latter mentioned drive section 122 is coupled to the input of the bottom elevator drive by the U-joint 116. The drive line 36 is supported on the cross beam 19 carried by the tongue 15 by a pivot bearing 125 which can swing in a vertical plane to accommodate the change of angle taken by the drive line as the tongue arms 16 and tongue extension 20 jackknife or pivot relative to each other in raising and lowering the scraper blade. Bearing sleeve 126 in the upper end of the pivot bearing 125 has a pivotal mounting on a transverse axis permitting up and down shifting of the elevator bottom drive 36. The telescoping drive section 120, in cooperation with the U-joints 121–123, permits the articulation of the tractor 12 with respect to the scraper 10.

As mentioned above, one of the important features of the invention is a design enabling the scraper to be shipped in disassembled form for assembly from a scraper kit which comprises all of the components banded or crated together enabling field assembly by the user without special jigs or fixtures.

Referring to FIG. 2 in this connection it will be noted that the arms 16 of the tongue have heavy side plates 130 on each side of the scraper side wall 18 and bolt on each side of a horizontal reinforcing rib 132 permanently secured to the side walls. The blade frame 58 and moldboard 81 at the front corners of the side walls 18 also bolt on as discussed above. The end wall 44 has inwardly directed flanges 137 which bolt to the side walls 18 at the rear. Between the main blade frame 58 at the front and the end wall 44 at the rear is the axle housing 48 spaced upwardly from the bottom-and extending across the bowl with the opposite ends being secured to the side walls by gusset plates 49 as in FIG. 3. Thus, the side walls 18 are rigidly held in spaced vertical relationship. In addition, the tongue 15 with the cross beam 19 further rigidifies and supports the front ends of the side walls. Of course, the bottom doors 56–60 and actuating linkage may be disassembled as well as the elevator 32. Likewise, the running gear is capable of being disassembled and in this connection reference is made to FIG. 3 where the axle section 50 is seen held within the axle housing 48 by means of a bolt-on outer lug 140 secured to the horizontal rib 132. By removal of the lugs 140, the rocking beams 37 and axle sections 50 may be withdrawn from the axle housing 48. It is then only necessary to unbolt the tongue, blade frame 58, axle housing 48 and the end wall 44 in order to collapse the scraper side walls 18 so that they may be shipped in a flat, side-by-side relationship.

While we have described and illustrated herein a preferred embodiment of our invention as incorporated in a particular mechanism, it will be appreciated that modifications may be made therein and that other uses may be found. Therefore, it should be understood that we intend to cover by the appended claims all such modifications as fall within the spirit and scope of our invention.

We claim:

1. In a mobile scraper adapted to be towed by a tractor having a hitch and power takeoff and having an open bowl adapted to be filled with earth material, a cutting blade extending across the front of the bowl, and a bottom door movable to an open position for dumping the earth material from the bowl, the improvement comprising the combination of a slat-type elevator comprising a pair of elevator sections side-by-side on opposite sides of a vertical plane in the center line of the bowl and a pair of tandem running gear means supporting the bowl on a transverse axis including wheel support means pivotally mounted on said transverse axis and extending fore and aft parallel to each other, four ground-engaging wheels, one at each end of said wheel support means rotatably supported one behind the other in tandem ground-engaging fashion, said wheel support means being mounted for independent oscillatory motion about said transverse axis and said slat-type elevator inclined at the front of the bowl generally above the cutting blade, elevator mounting means swingably supporting the elevator permitting it to rise and fall in relationship to the dirt when the blade is in cutting engagement with the ground, elevator drive means at the bottom of said elevator having a power input, said elevator drive means being common to both said elevator sections, a drive line connectable between the tractor power takeoff and said power input, and a tongue for towing the scraper adapted to be coupled to the tractor hitch.

2. The improvement according to claim 1 wherein the running gear means comprises a tubular axle housing extending across the bowl, a pair of axle sections, one received in each end of the axle housing and projecting beyond the sides of the bowl, said wheel support means being fixed to said axle sections and retainer means for holding the axle sections against axial movement while permitting said oscillatory motion.

3. The improvement according to claim 1 wherein the tandem running gear means includes a transverse axle housing secured between the side walls of the bowl spaced upwardly from the bottom thereof, axle means journaled in the axle housing, said wheel support means comprising a pair of rocking beams, one mounted on each side of the bowl to said axle means, a pair of stub axles, one at each end of each rocking beam and four ground engaging wheels, two on each side of the bowl, one behind the other, mounted on said stub axles.

4. The improvement according to claim 1 wherein the said elevator comprises an elevator frame including a central support member, a crossbar adjacent the upper end of said member pivotally supported on each side wall of the bowl, and upper driven shaft supported above said crossbar, a pair of laterally spaced idler wheels mounted on the driven shaft on each side of said vertical plane, a driving shaft mounted at the lower end of said central support member, a pair of laterally spaced driving sprockets on the driving shaft on each side of said plane aligned with each pair of sprockets and idler wheels and a plurality of longitudinally spaced flights fastened between individual pairs of chains forming two elevator paths on each side of the bowl.

5. The improvement according to claim 4 wherein the said driveline includes at least one telescoping drive section connectable between the tractor power takeoff and said power input to the elevator drive means.

6. The improvement according to claim 5 wherein said driveline includes a first drive section, universal coupling and a second drive section, the adjacent end of the said first and second drive sections being joined by said universal coupling.

7. A mobile scraper adapted to be towed by a tractor having a hitch and power takeoff comprising a bowl having laterally spaced side walls, a main blade secured between the side walls at the front of the scraper, an elevator mechanism inclined at the front of the bowl and being engageable with the ground in front of the blade to assist in filling the bowl with earth material, and elevator mechanism comprising a pair of elevator sections, side-by-side on opposite sides of the vertical plane in the center line of the bowl, elevator drive means common to both elevator sections located at the bottom having a power input in said plane, a drive line connectable between the tractor power takeoff and power input, and a tongue for towing the scraper adapted to be trailingly coupled to the tractor hitch, said bottom of the scraper bowl closed by front and rear movable door means, said front door means having a floor portion extending from adjacent the main to said rear door means, said rear door means having floor portion extending from the trailing edge of the floor portion of the front door means rearwardly thereof, end wall means fixed between the side walls of the bowl engageable with the trailing end of the rear door means, a first transverse pivot axis spaced above the floor portion of the front door means, a second transverse pivot axis spaced above the floor portion of the rear door means and actuating means operable to cause the front and rear door means to pivot rearwardly and upwardly about said transverse pivot axes.

8. A mobile scraper according to claim 7 wherein mold-board means project laterally outwardly from each end of the main blade, a blade frame supporting the main blade and moldboard means, pushrod means extendible into said moldboard means on a line generally parallel to the main blade, and an actuating means operable with said door actuating means for reciprocating said pushrod means to clean out material adhering in the area of the moldboard means.

9. A four-wheeled scraper adapted to be towed by a tractor having a hitch and power takeoff comprising a bowl having an open front and laterally spaced side walls, a fixed rear end wall secured between said side walls, four ground engaging wheels, two on each side, one behind the other in tandem relationship, a suspension supporting the bowl on the wheels permitting oscillation of the wheels about a transverse axis extending between the wheels, a blade frame extending across the lower front of the bowl, a cutting blade supported on the blade frame, said bowl being open at the bottom between said blade frame and end wall, a front door providing a floor in the front portion of the bowl in a closed position and swingably mounted on said side walls, a rear door providing a floor in the rear portion of the bowl between said front door end wall in a closed position and swingably mounted on said side walls, actuating means for swinging said doors to open and close said bottom, an elevator mounted across the front of said bowl having two loading paths, one on each side of the bowl with a space in between, an elevator drive shaft at the bottom having an input between said elevator paths and drivingly connected to each elevator path, a drive line connected on one end to the input to said elevator bottom drive and adapted to be connected on the other end to said tractor power takeoff, a scraper tongue extending forwardly from the side walls of the bowl having a transverse beam member supporting said drive line, a tongue extension pivotally connected to the transverse beam member on one end and adapted to be connected to the tractor hitch on the other end, and power cylinder means adapted to be controlled from the tractor and connected on one end to the tongue extension and on the other end to said transverse beam member.

10. A four-wheeled scraper according to claim 9 wherein said blade frame, tongue and end wall are each removably secured between the side walls so as to permit disassembly of the bowl.

11. A four-wheeled scraper according to claim 10 wherein said suspension includes a transverse axle member removably secured between the side walls of the bowl, wheel support members removably supported on said axle member on each side of the bowl and on which said wheels are mounted, and lug means removably attached to the side walls preventing axial movement of said wheels support members relative to said axle member.

* * * * *